United States Patent [19]

Hedden et al.

[11] Patent Number: 4,467,916

[45] Date of Patent: Aug. 28, 1984

[54] TUBULAR GLASS FIBER PACKAGE AND METHOD

[75] Inventors: Jerry C. Hedden; Lesley M. Allen, both of Shelby, N.C.

[73] Assignee: PPG Industries, Inc., Pittsburgh, Pa.

[21] Appl. No.: 371,899

[22] Filed: Apr. 26, 1982

[51] Int. Cl.[3] ..... B65H 55/02

[52] U.S. Cl. ..... 206/410; 206/409; 206/446; 206/497; 242/172

[58] Field of Search ..... 206/409, 410, 413, 446, 206/497; 242/170, 171, 172; 215/1 C; 264/235

[56] References Cited

U.S. PATENT DOCUMENTS

| | | | |
|---|---|---|---|
| 1,937,468 | 11/1933 | Talbot | 206/497 |
| 3,040,968 | 6/1962 | Long et al. | 229/87 F |
| 3,092,439 | 6/1963 | Harrison | 264/154 |
| 3,097,787 | 7/1963 | Schur | 229/53 |
| 3,121,132 | 2/1964 | Del Bene | 264/235 |
| 3,260,358 | 7/1966 | Gottily | 206/410 |
| 3,638,790 | 2/1972 | Schmid et al. | 206/446 |
| 3,640,048 | 2/1972 | Zelnick et al. | 53/442 |
| 3,667,598 | 6/1972 | Zelnick et al. | 206/386 |
| 3,731,792 | 5/1973 | Rolston | 206/389 |
| 3,747,746 | 7/1973 | Newman et al. | 206/409 |
| 3,915,301 | 10/1975 | Gray et al. | 206/386 |
| 3,945,493 | 3/1976 | Cardinal | 206/386 |
| 3,983,997 | 10/1976 | Warshaw | 206/389 |
| 4,220,295 | 9/1980 | Green et al. | 242/170 |
| 4,300,734 | 11/1981 | Green et al. | 242/170 |
| 4,348,439 | 9/1982 | Jones | 206/409 |

OTHER PUBLICATIONS

New Developments in Packaging Films, by Fred B. Shaw, Modern Packaging Encyclopedia, Dec. 1979.

Properties of Plastic Resins, Resins for Molding and Extrusion, Modern Packaging Encyclopedia and Planning Guide Specialty Films Chart, Coextrusions and Copolymers, McGraw-Hill, Inc., 1974.

Band-O-Matics, Great Lakes Corporation.

The Unicorn, The Unicorn PSW 102, Toriod, Stretch Bander, Overwrap for your Stretch Packaging Requirements, Overwrap Equipment Corporation, Fairfield, NJ.

Lan-Ringer Stretch Overwrap Systems, Lantech, Inc., Louisville, KY.

*Primary Examiner*—William T. Dixon, Jr.
*Assistant Examiner*—Brenda J. Ehrhardt
*Attorney, Agent, or Firm*—Kenneth J. Stachel

[57] ABSTRACT

A package of wound glass fiber strand from which the glass fiber strands can be removed more efficiently for feeding into processing operations. The wound package of glass fiber strand is a package of superimposed annular layers of glass fiber strands having a central longitudinal, cylindrical cavity about which the strands are wound and having an outer cylindrical surface and a substantially flat circular top and bottom section. This package is covered with a stretchable polymeric film having a stiffness modulus of at least 1200 pounds/-square inch and an elongation of about at least 5 and a thickness of about 0.75 to about 10 mils. The stretchable polymeric film is stretched around the package of glass fiber strands with a force greater than 4 pounds (18 Newtons) to stretch the film to cover the outer peripheral, cylindrical portion and to extend at least 0.5 inches (1.27 cm.) radially onto the top and bottom flat circular portions of the package. The polymeric film is stretched around the package for one or more wraps. The method of producing the wrapped package includes preparing a package of glass fiber strands wound in superimposed annular layers to have a central longitudinal, cylindrical cavity and an outer cylindrical surface and a substantially flat circular top and bottom section where at least one free end of the glass fiber strand extends into the central cavity for removal from the interior to the exterior of the package with the package prepared a stretchable polymeric material is selected having a stress modulus of at least about 1200 pounds per square inch and a percent elongation of at least about 5 and a thickness of about 0.75 to 10 mils. This stretchable polymeric film is wrapped about the package with a stretching force of greater than 4 pounds (18 Newtons) to stretch the film to cover the outer cylindrical portion of the package and to extend radially 0.5 inches onto the flat top and bottom circular portions of the package in one or more wraps.

20 Claims, 3 Drawing Figures

TUBULAR GLASS FIBER PACKAGE AND METHOD

BACKGROUND OF THE INVENTION

The present invention is directed to a tubular package of glass fiber strand or strands having improved pay-out, when the glass fibers are removed from the package. More particularly, the present invention is directed to a package of continuous glass fiber strand or strands, where the strand or strands can be removed from the package from the inside of the package to the outside of the package so that most or all of the strand or strands in the package can be removed from the package.

Continuous glass fiber strands are formed from numerous, fine, individual glass fibers, which are attenuated from small orifices in a bushing, which contains the molten glass. During forming the glass fibers are treated with a binder or sizing composition and then gathered into strands and wound around a mandrel into a package. The winder usually provides the attenuation forces necessary to from the glass fibers from the orifices of the bushing. The resulting wound package is usually dried and the dried package is ready for further processing or for shipment.

In further processing of the dried package of continuous glass fiber strand or strands, many of the strands may be combined and wound in parallel without a twist into what is known as a roving package. Rovings are made by placing a number of packages from forming on a creel and collecting the strands from each package together and passing them through guide eyes and tensioning devices, and then winding the strands together as one bundle of strands onto a winding machine that is standard in the industry. In addition to producing the roving packages from packages of glass fiber strand from forming, the art has developed the method and necessary apparatus for forming precision wound roving packages of glass fiber strands directly during the glass fiber forming process. The roving packages from either production process generally have an exterior cylindrical shape with a flat surface at both ends of the package. The package also has an internal longitudinal cylindrical cavity present because of the mandrel on which the package was wound. Continuous strands can be removed from these cylindrical roving packages and used as reinforcement of polymeric or elastomeric materials, or for chopping or weaving or impregnation with a resin for applications such as filament winding and pultrusion.

Generally, the users of roving packages prefer to remove the roving or bundle of strand or strands, hereinafter referred to in the specification and claims as "strands", from the package from the internal cavity to the exterior cylindrical surface. Also, users like to have two free ends of strands in the internal cavity so that one end can be tied to the free end of another package and as the strands are removed from the first package, the tied ends automatically transfer the feed to the second package, when the first package is totally drawn. Therefore, users of roving packages and other packages of continuous glass fiber strands desire that the strands within a package can be totally drawn from the package. This drawing of the strands from the package is referred to in the art as the pay-out of the strands.

Several problems arise from the unwinding of the strands from the inside of the outside of the package. As the package is unwound, the shell of the package, i.e., the remaining strands present in annular overlapping layers, becomes thinner. This may eventually lead to the package becoming unstable so that the shell may collapse in upon itself. Such a collapse would cause the remaining strands to become entangled. This results in the balance of strands from the package being discarded and decreases the efficiency of continuously drawing strands from one package to the next. Another problem that may arise if the package shell does not collapse in upon itself, is that the remaining package may become so light that pulling the strand from the inside lifts the package entirely rather than unraveling the last few layers of strands from the package. This lifting of the package would be due to the inability of the weight of the light package to overcome the adhesive forces between the strands, which are generated from the binder or sizing composition present on the strands. This again leads to tangles and requires the discarding of the balance of the package, and again, decreases the efficiency of continuously drawing the strands from one package to the next.

The art of removing glass fiber strands from the interior of a package to the exterior of the package has suggested several solutions to the problem of not obtaining complete pay-out of the strands from a package of strands. An early attempt is described in U.S. Pat. No. 2,630,280, where the roving package was placed in a chamber. On the top of the roving package was a washer-like member that acted as a strand guide and as a restraint to any vertical movement of the package. Collapse of the package was prevented by creating a vacuum in the chamber in which the roving package was located to thus force the walls of the roving package against the walls of the chamber. But such an apparatus involves the use of a cumbersome support apparatus such as a vacuum pump.

More recently, the art has approached the problem by providing several different package coverings. For instance, shrink wrap polymeric films have been used alone or in combination with kraft paper or an adhesive support layer. Also, a collapsible elastic membrane has been suggested for wrapping the roving packages, where the membrane is used alone or with a control layer interspersed between the layers of the elastic membrane. With the use of the control layer, the collapsible elastic membrane collapses less than when the collapsible elastic membrane is used alone. The use of heat shrink polymeric films is expensive because of the cost of the heat shrink film and of the equipment needed to shrink the film around a package of strands. Also the energy needed to shrink the film adds to the cost of using such materials. With the use of collapsible elastic membranes, the stretched protective wrap around the package of continuous glass fiber strand may collapse in on the strands or dislodge the strands when only a few layers of the glass fiber strand are left to be drawn from the package. Such a collapse or dislodging may cause the protective film to be entangled with the strands being drawn so as to cause the film to be drawn along with the continuous glass fiber strand. This decreases the efficiency of continuously drawing glass fiber strands from one package to another.

Therefore, the art is still searching for a package of continuous glass fiber strands, where the package can be completely paid-out, i.e., all of the strands that are in the package can be removed. Such a package would improve the efficiency of drawing glass fiber strands from one package and connecting the glass fiber strands of one package to the glass fiber strands of another package for removal of the strands from the second package.

It is an object of the present invention to provide a package of glass fiber strands wound in superimposed annular layers that is unwound from the inside to the outside of the package and that has improved pay-out of the glass fiber strands wherein slumping of the various layers of glass fiber strands is reduced and the pay-out of the strands from the package is improved, and the transfer from strands of one package to the strands of another package is improved.

It is a further object of the present invention to provide a method of producing a package of glass fiber strands wound in superimposed annular layers that can be unwound from the inside layer to the outside layer of the package, wherein slumping of the various layers of glass fiber strands is reduced and the pay-out of the strands from the package is improved, and the transfer from strands of one package to those of another package is improved.

SUMMARY OF THE INVENTION

Accordingly, a tubular, generally cylindrical package of glass fiber strands is provided that has improved pay-out of the strands, when the strands are drawn from the interior to the exterior of the package. The package of glass fiber strands has numerous superimposed annular layers of strands wound about an internal longitudinal cylindrical cavity. The exterior of the package is generally cylindrical in shape with a substantially flat top and bottom section. Around the peripheral exterior surface and extending at least around 0.5 inches (1.87 cm.) onto the top and bottom sections of the packages is a stretched polymeric film that conforms to the surface characteristics or features of the glass fiber strand package. The polymeric film has a stiffness modulus before stretching of at least around 1200 psi (84 kilograms per centimeter$^2$). The stretchable polymeric film has at least about 5 percent elongation and a thickness of around 0.75 to around 10 mils. The polymeric film is present in one or more layers depending upon the stiffness modulus and thickness of the film. The polymeric material is stretched to a degree resulting from a pulling force in excess of 4 pounds (18 Newtons) during wrapping. The force to stretch the polymeric film is not great enough to cause the stretchable polymeric film to collapse when all of the strand is removed from the package.

The tubular, substantially cylindrical package of continuous glass fiber strands with the noncollapsing, conformational polymeric film is produced by the following method. The tubular, substantially cylindrical package of continuous glass fiber strands is prepared with superimposed annular layers of strands about a longitudinal cylindrical cavity with a substantially flat top and bottom section. The package has one or more free ends of the strands capable of entering the cylindrical cavity. A stretchable polymeric film is selected that is self-sustaining or noncollapsable when in a cylindrical shape and that will conform to the glass fiber strand package when stretched. The stretchable polymeric film has a thickness of about 0.75 to about 10 mils and a stiffness modulus of around at least 1200 pound/square inch (84 kilograms per centimeters$^2$). The polymeric film is wrapped around the exterior cylindrical surface of the package in one or more layers to extend at least about 0.5 inches (1.27 cm.) onto the top and bottom sections of the package. The wrapping is performed with greater than 4 pounds of pulling force (18 Newtons) to stretch the film to conform to the exterior surface features of the package of glass fiber strand.

DETAILED DESCRIPTION OF THE INVENTION

It is believed but the present invention is not limited to this belief, that the improvement in pay-out, that is, of removing the glass fiber strand from a package and glass fiber strand wound in superimposed annular layers is a benefit of the package being wrapped in such a manner and with such materials that the wrapped package has an outer conformational, free-standing film. The polymeric film is conformational in that it conforms to the features and characteristics of the outer surface of the glass fiber strand package through the stretching of the polymeric film. The polymeric film is free-standing in that the type, stiffness modulus and thickness of film used, and the method of wrapping, and number of wraps and the degree of stretching and the elastic memory of the film do not cause the film to collapse when all of the strand from the wrapped glass fiber strand package has been removed.

Figure 1:
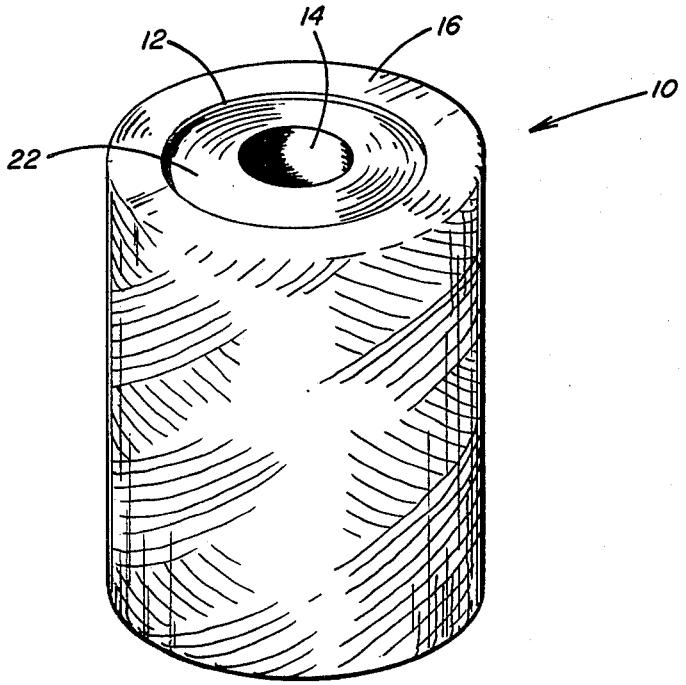
FIG. 1 is a drawing of the package of glass fiber strands wound in annular layers having a covering of the stretched polymeric film.

Turning to FIG. 1, there is shown a drawing of the wrapped fiber glass strand package of the present invention. The package indicated by numeral 10 can be any glass fiber strand package having one or more continuous glass fiber strands. The package could be the type of package produced during the formation of glass fiber strands, where the core has been removed. Also, the package could be a roving package of glass fiber strands produced during forming or from a plurality of forming packages. The glass fiber strand could be produced from any glass fiber batch material such as "E-glass" or "621-glass" or any more environmentally acceptable derivative thereof.

The package is formed by winding one or more glass fiber strands on a mandrel or on a core, which can be cardboard or plastic placed on a mandrel of a winding machine, in a overlapping annular fashion. When a myriad of layers have built up on the package, the package is removed from the mandrel and if there is a core, it can either be removed or retained for handling. The package has a substantially flat top and bottom sections due to the overlapping lay-down of the glass fiber strands in forming the wound package. The build up of the layers as the continuous glass fiber strand traverses back and forth on the winder, is nearly perpendicular to the axis of the peripheral surface of the package. This squared off package at both the top and bottom portion of the package produces the substantially flat top and bottom sections of the package. In the winding of the glass fiber strands into the package, the traverse of the continuous glass fiber strand during winding may falter a bit from time to time and the package may not be exactly square at the edges. Some packages may even have a rounded edge and this is why the top and bottom sections of the package are only substantially flat rather than totally flat. The winding of the glass fiber strands into such a package can be performed on any of the conventional winding apparatus known to those skilled in the art. The center of the package has the longitudinal cylindrical cavity present from the space that the mandrel occupied during the winding of the package.

In FIG. 1, package 10 has a outer wrapping of stretched polymeric film shown as numeral 12. The film, 12 on the package extends over the top of the package for at least about 0.5 inches (1.27 cm.). The film also extends over the bottom of the package for at least 0.5 inches (1.37 cm.) which is not shown in FIG. 1. The stretched polymeric film is selected from any polymeric film which has a stress modulus of at least 1200 pounds/square inch (psi) (84 kilograms per $cm^2$) at 100% elongation but which also has a percent elongation of at least about 5 and as great as 400 or more. Nonexclusive examples of such films include films of polyvinyl chloride, both unplasticized and with amounts of plasticization as great as around 30 weight percent, polyvinylidene chloride, low, medium or high density polyethylene, polybutylene, nylon cast with a polyvinylidene coating on one side, nylon ionomer, ethylene vinyl acetate copolymer with up to around 12 percent vinyl acetate, and co-extruded films such as those produced from low and high density polyethylene, high density polyethylene and ethylene vinyl acetate, low density polyethylene and polyvinylidene chloride, high density polyethylene-nylon-ethylene vinyl acetate, and propylene-ethylene copolymer polyethylene-oriented polypropylene and the like.

The combined properties of stretchability and noncollapsibility are illustrated by the preferred material which is the plasticized polyvinyl chloride film. The polyvinyl chloride can have an amount of plasticization which an be as great as around 30 weight percent of the polymer as long as the stiffness modulus of the material is greater than about 1200 psi (84kg/$cm^2$) and the percent elongation of the material allows for stretching without tearing. The amount of plasticization will vary with the type of plasticizer used like esters of aliphatic and aromatic di- and tricarboxylic acids, organic phosphates, high molecular weight alkyl aromatic hydrocarbons, chlorinated aromatic and aliphatic hydrocarbons. With increasing amounts of plasticizer in polyvinyl chloride, the addition of the plasticizer makes the resin softer and more flexible and reduces the modulus and tensile strength and increases elongation. With the lower concentrations of plasticizer, the increases and decreases are less after a threshold concentration of the plasticizer has been achieved. When the plasticizer has increased polarity and molecular compactness, smaller concentrations of the plasticizer, that is less than 30 weight percent, are used to obtain the same physical properties for the film.

The other polymeric materials may also be plasticized but usually not to the same extent as the polyvinyl chloride, since polyvinyl chloride is rather unique in its ability to accept large amounts of plasticizers with a resultant gradual change in physical properties from a rigid solid to a soft solid. Other polymers when plasticized undergo this transformation more rapidly on either a slight increase of plasticizer content or a slight decrease in temperature. Therefore, when polyethylene vinyl acetate is used, the amount of acetate copolymer more dramatically affects the stress modulus and elongation percent of the film and is usually not greater than around 12 percent of the copolymer.

The dimensions of the film depend somewhat on the package to be wrapped, and the number of times the film is wrapped around the package and the stiffness modulus and percent elongation of the film. Generally, the thickness of the film ranges from 0.75 mils to 10 mils (0.01905 to 0.254 mm.). The thicker film may be wrapped around the package fewer times than the thinner films to achieve the same result. Also, the films with lower stiffness modulus may need less of a stretching force and more wraps around the package. It is preferred that the wrap is a multi-layer wrap, which can be convoluted or unconvoluted as long as the wrap extends 0.5 inches (1.27 cm.) or more over the ends of the peripheral surface of the package onto the top and bottom sections. The wrap can also be long enough or wrapped in such a convoluted fashion that the wrap completely covers the bottom section of the package. For the extension of the stretch film across the top section of the package, it should be at least around 0.5 inches (1.27 cm.) but can be a greater extension but in no case great enough to extend into the longitudinal cylindrical cavity of the package.

In addition to the aforementioned polymeric films having the requisite stiffness modulus and percent elongation, it is preferred that the polymeric film have a lower degree of stretch retention, because a high degree of stretch retention may cause the package to collapse upon itself when the glass fiber strand is removed from the package. The polymeric film can be a continuous film or a discontinuous film, where the discontinuity may take the form of perforations in the film. For some packages, such perforations would allow moisture to pass from the package. The film is stretched to conform to the features and the characteristics of the outer surface of the glass fiber strand package. It is believed without limiting the invention, that in being stretched the film provides its maximum contact with the strands in the outer layers making up the surface of the package and assists in holding the strands in place until they are removed from the package while the glass fiber strands are being drawn. A polymeric film that has been found preferable for use in the present invention is that available from Borden Chemical Company, Resinite Division under trade designation RW/21 plasticized polyvinyl chloride film. Another suitable film is the polyvinyl chloride film designated PS-26 also available from Borden. This latter film varies from the former in that it has a greater amount of plasticizer.

These and the other polymeric films useful in the present invention have the required stiffness modulus and percent elongation, where these parameters are measured by the handle-O-meter and ASTMD882 methods respectively. The tests for stiffness in grams measured by the handle-O-meter is more fully described in the article "Testing Films for Machinability", Modern Packaging, September, 1967, pg. 171, which is hereby incorporated by reference. The ethylene vinyl acetate films include both varieties available commercially, that is the low level vinyl acetate variety having from about 2 to about 5 percent vinyl acetate and the higher vinyl acetate variety having 10 to 12 percent vinyl acetate. The former ethylene vinyl acetate copolymer has properties comparable to polyvinyl chloride but with a higher stress retention, while the latter has more tack, elasticity and higher puncture resistance while stretching 35 to 40 percent more. The polyvinyl chloride polymeric film is preferred, since it has less stress retention than the low acetate ethylene vinyl acetate film, or a cast low density polyethylene, film or the high acetate level ethylene vinyl acetate copolymer.

The polymeric film is wrapped around the package of glass fiber strands on any conventional wrapper suitable for wrapping cylindrical objects and which can stretch the film as it is wrapped around the cylindrical object. Examples include stretch wrap equipment from American Engineering and Design Company, Arenco Machine Company, Clamco Corporation, Hobart Corporation, Lantech, Inc. and Overwrap Equipment Corporation. It is preferred to use the Unicorn Wrapping Machine from Overwrap Equipment Corporation. The package is mounted on one of the rotatable shafts projecting outward from the machine, while the polymeric film to be wrapped around the glass fiber strand package is located on the other rotatable shaft projecting from the machine. The film is attached to the cylindrical glass fiber strand package and the film shaft is rotated around the shaft having the glass fiber strand package by both projecting shafts being located across from each other on the circular moving member of the machine. On the circular rotating member of the machine, both shafts are able to rotate. Therefore, as the film containing shaft is rotated with the glass fiber strand package shaft on the rotating circular portion of the machine, both individual shafts rotate so that the package is covered with the film. The film shaft of the machine has an adjustable brake mechanism which applies a predetermined amount of drag to the film shaft such that the film is wrapped about the glass fiber strand package under a predetermined amount of tension to stretch the film. Any other suitable apparatus for applying film to a circular object while stretching the film can also be used. The brake mechanism is set on the machine so that the stretching force applied to the film as the glass fiber strand package is being wrapped is greater than 4 pounds (18 Newtons) and preferably around 6 to about 20 for the film which preferably has a 19 inch width for glass fiber strand packages that have a height of 12 inches.

After the film is wrapped with tension about the package of glass fiber strands, the film is cut and if the material is the polyvinyl chloride film plasticized or unplasticized or a cast low density polyethylene film or an ethylene vinyl acetate film with 10 to 12 percent acetate the stretch wrap will cling to itself. If other films are used, a heat seal can be placed on the end of the film that contacts the beginning of the film that has been wrapped on the package. The film can be wrapped around the package from once to several layers depending upon the thickness and stiffness modulus of the film. Films that are thinner or that have a lower stiffness modulus are wrapped in more layers around the package. The thicker films require fewer wraps. It is preferred that the film have a thickness of about 0.75 mils to about 3 mils (0.01905 mm. to 0.0762 mm.). It is preferred that this thickness of film is wrapped around the package from about 2 to 5 times. If the film is tensioned to too great a degree, a film with a lower percent elongation may be overly stretched, therefore, the tension upon the film should not exceed about 20 pounds (90 Newtons) for a plasticized polyvinyl chloride film having a percent elongation over 450 percent. After the wrap has been sealed, the wrapped package is removed from the wrapping machine. If the wrapped package has a stretched film with too great a degree of stress retention because of using a film having a high degree of stretch retention or because the film is stretched to a high degree by using a large stretching force, the package may be heated at elevated temperatures to reduce the stretch retention.

Also, FIG. 1 shows the cavity 14 of the package through which the strand is removed. The extension of the film into the top of the package is shown at 16 while the overlapping layers of strand in the package are shown at 22. As an alternative, the film may be wrapped around the package.

Figure 2:
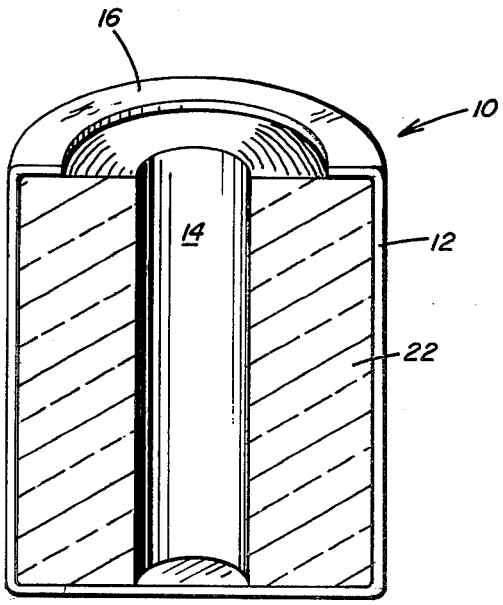
FIG. 2 is a drawing of a vertical cut-away view of the package of FIG. 1.

FIG. 2 shows a cutaway view of the wrapped package of FIG. 1 where the film layer 12 is wrapped around strands 22. The package 10 has the longitudinal, cylindrical cavity 14.

Figure 3:
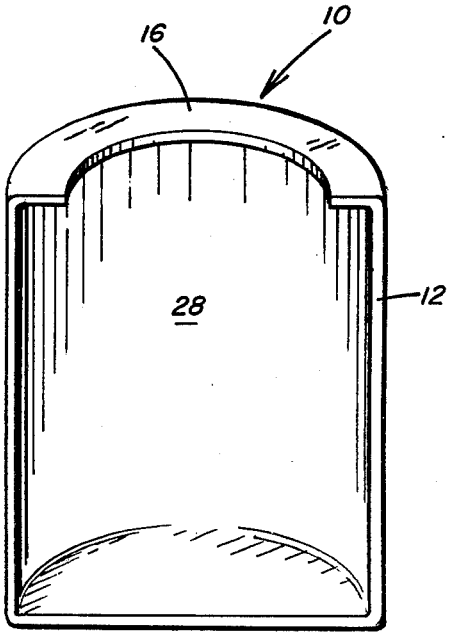
FIG. 3 is a vertical cut-away view of the polymeric film left after all of the glass fiber strand of package 1 has been withdrawn from the package.

FIG. 3 shows the stretched polymeric film after the strands 22 of FIGS. 1 or 2 have been removed from the package. FIG. 3 shows the noncollapsible nature of the stretched polymeric film. Here film 12 has essentially the same dimensions as it did in FIGS. 1 and 2 when it was wrapped around the glass fiber strand package. In FIG. 3 all of the glass fiber strands 22 of FIGS. 1 or 2, have been removed through the cavity 14 and what remains is a shell of the stretched polymeric film 28. The shell of the film 28 allows improved payout of the glass fiber strands from the wrapped package so that the last end of glass fiber strand coming from the package can be attached to the beginning end of glass fiber strand from another package for good transferability of strand from one package to another, when the strand is being drawn from a plurality of packages as a feed for producing fiber reinforced plastics. The glass fiber strand can be removed from the wrapped glass fiber strand package or a plurality of packages by any method and apparatus known to those skilled in the art for using glass fiber strands as a feed for any processing operation such as that used in making fiber reinforced plastics. The amount of force used to remove the glass fiber strands from the package is not limited but is usually in the range of less than 1 to several pounds. In the operation of removing the glass fiber strand from a plurality of wrapped packages, it is preferred that the packages are wrapped in such a manner as to leave two free ends of the glass fiber strands in the longitudinal cylindrical cavity of the package. This way one end can be fed into the processing machinery and the other end can be tied to a lead end of another wrapped package. With the use of the wrapped package, improved transfer of glass fiber strand from one package to another is achieved along with the improvement in pay-out of glass fiber strands.

In an alternative method of the present invention, the wrapped packages of the present invention can be treated to reduce the stretch retention of the polymeric film wrapped about the package. It would be desirable to reduce the stretch retention when a stretchable polymeric film is used that has a high stretch retention or has been stretched with a high force and the film has a high percent elongation. These films include those of ethylene vinyl acetate copolymer, both low and high acetate content versions and cast low density polyethylene and highly plasticized polyvinyl chloride. Also, such a reduction in stretch retention would be desirable when the sized glass fiber strands wound in the package have a slippery highly lubricated coating on the fibers making up the strands. To reduce the stretch retention, the wrapped package is heated at an elevated temperature for a period of time sufficient to reduce the stretch retention to the desired degree. For instance, a wound package of glass fiber strands useful in manufacturing tire cord that is stretched wrapped with a polyvinyl chloride film is heated at a temperature of around 250° F. (120° C.) for around 5 minutes to achieve nearly a 100 percent reduction in stretch retention of the stretched film. The elevated temperatures and heating times can be varied to achieve the desired percent reduction of stretch retention.

Additional information concerning the preferred embodiment and other examples of the present invention are presented in the following examples.

EXAMPLES

Several polymeric films having a thickness of 1 mil (0.0254 mm.) were used to wrap one of two various types of glass fiber strand packages. In the wrapping, the force was varied to give various stretching to the film around the glass fiber strand package. All of the packages were used in producing chopped glass fiber strands so that the strands were withdrawn from the center of the packages, and fed into a chopper. The results of the testing showed that the polyvinyl chloride film wrapped around the glass fiber strand package with a certain force gave the best results in the glass fiber strand paying-out from the center of the package. The results are shown in Table I. The PS-26 polyvinyl chloride has a greater amount of plasticization than the RW-21 polyvinyl chloride. The results show that with a film that has a lower stiffness modulus and higher percent elongation like the PS-26 film, a lower pulling force from greater than 4 pounds to around 6 pounds can be used. Also, for such a film the stretching force should not be greater than around 20 pounds (89 Newtons) if the stretch wrapped package is not to be heat treated to reduce stretch retention.

TABLE I

PAY-OUT AND TRANSFER PERFORMANCE OF WRAPPED PACKAGES

| | Polymeric Film | | Package Type | | Stretch Force for Wrapping | | Results | |
|---|---|---|---|---|---|---|---|---|
| Sample | Type | Thickness mil/mm | Glass Fiber Diameter | Height in/mm | Machine Tension/lb(f)/ Newtons | Number of Wraps | Pay-out | Transfer |
| 1 | PS-26 (Poly) vinylchloride | 1 | T | 10/ | 0/4–6/18–27 | 3 | Yes | Yes |
| 2 | PS-26 (Poly) vinylchloride | 1/ | T | 10/ | 20/6–8/27–36 | 3 | Yes | Yes |
| 3 | PS-26 (Poly) vinylchloride | 1/ | K | 12/ | 20/6–8/27–36 | 3 | Yes | Yes |
| 4 | PS-26 (Poly) vinylchloride | 1/ | K | 12/ | 40/10–15/44–67 | 3 | Film collapsed after pay-out | Yes |
| 5 | Polyvinyl chloride (Resinite RW-21) | 1/ | T | 10/ | 0/4–6/18–27 | 3 | Minor shelling and snagging | Looped on itself |
| 6 | Polyvinyl chloride (Resinite RW-21) | 1/ | T | 10/ | 10/6/27 | 3 | Yes | Yes |

I claim:

1. A tubular package of continuous sized glass fiber strand or strands, comprising:

a. continuous glass fiber strand or strands wound in superimposed annular layers to have a longitudinal, cylindrical cavity in the center of the package and an outer cylindrical shape and a substantially flat top and bottom section, where one or more free ends of glass fiber strands extend into the cavity for removal from the center of the package, b. polymeric film stretched around the outer peripheral surface of the package and extending at least about 0.5 inches (1.27 cm.) onto the flat top and bottom sections of the package, where the polymeric film as an unstretched film has a stress modulus of around at least 1200 pound/square inch at 100 percent elongation and a percent elongation of at least about 5 and a thickness of about 0.75 to about 10 mils that has been stretched around the package with a pulling force of greater than 4 pounds (18 Newtons) but not great enough to cause the stretched film to collapse when all of the strand or strands have been removed through the center of the package to produce conformational film about the outer peripheral surface and portions of the top and bottom sections of the package that is free-standing upon removal of the strand or strands from the center of the package.

2. Article of claim 1, wherein the stretched film extends across the entire bottom section of the package.

3. Article of claim 1, wherein the stretched film is wrapped around the circular package of glass fiber strands at least twice.

4. Article of claim 1, wherein the polymeric film is selected from the group consisting of polyvinyl chloride, both unplasticized and with amounts of plasticization as great as around 30 weight percent, polyvinylidene chloride, low, medium or high density polyethylene, polybutylene, nylon cast with polyvinylidene coating on one side, nylon ionomer, ethylene vinyl acetate copolymer with up to around 12 percent vinyl acetate, and coextruded films such as those produced from low and high density polyethylene, high density polyethylene and ethylene vinyl acetate, low density polyethylene and vinylidene chloride, high density polyethylene-nylon-ethylene vinyl acetate, propylene-ethylene copolymer, and polyethylene-oriented polypropylene.

5. Article of claim 1, having two free ends in the center longitudinal cavity of the package.

6. Plurality of articles of claim 5, wherein one free end of one package is available for feeding into processing equipment and the other free end of the article is attached to one free end of another article.

7. Method of producing a tubular package of continuous strand or strands wrapped with a stretchable material to allow for improved pay-out of the strand or strands from the package, comprising:

a. preparing a tubular package of continuous glass fiber strand or strands wound in superimposed annular layers to form a longitudinal, cylindrical cavity in the center of the package and having an outer cylindrical shape and a substantially flat top and bottom circular section, with one or more free ends of the glass fiber strand or strands entering the cavity for removal from the package from the interior to the exterior of the package, b. selecting a stretchable polymeric film having a stretch modulus of around at least 1200 pounds/-square inch at 100 percent elongation and a percent elongation from at least about 5 and a thickness of about 0.75 to 10 mils, c. wrapping the stretchable polymeric film around the exterior cylindrical surface of the package with a force greater than 4 pounds (18 Newtons) but not great enough to cause the stretched film to collapse when all of the strand or strands have been removed through the cylindrical cavity in the center of the package, in one or more wraps to cover the exterior peripheral cylindrical surface of the package and to extend onto the flat top and bottom section at least about 0.5 inches radially so that the film is stretched at least about an elongation of about 5 percent, d. cutting the stretchable polymeric film from its source and attaching the end to the wrapped package to produce a package of continuous strand with a conformational film covering that is free-standing upon removal of the strand or strands from the center of the package.

8. Method of claim 7, wherein the polymeric film is wrapped about the package so that the bottom circular section is completely covered.

9. Method of claim 7, wherein the cut end of the polymeric film clings to the wrapped package.

10. Method of claim 7, wherein the cut end of the polymeric film is heat sealed to the wrapped package.

11. Method of claim 7, wherein the wrapped package is heated at an elevated temperature for a time sufficient to reduce the stress retention of the stretched polymeric film.

12. Article of claim 1, wherein the stretched polymeric film is a multi-layered wrap.

13. Article of claim 12, wherein the stretched polymeric film has three wraps around the package.

14. Article of claim 1, wherein the stretched polymeric film has a low degree of stress retention.

15. Article of claim 1, wherein the polymeric film is stretched around the package with a pulling force not greater than 20 pounds for a film having a 450 percent elongation.

16. Article of claim 15, wherein the pulling force is in the range of around 6 to about 20 pounds.

17. Method of claim 7, wherein the polymeric film is selected from the group consisting of polyvinyl chloride, both unplasticized and with amounts of plasticization as great as around 30 weight percent, polyvinylidene chloride, low, medium or high density polyethylene, polybutylene, nylon cast with polyvinylidene coating on one side, nylon ionomer, ethylene vinyl acetate copolymer with up to around 12 percent vinyl acetate, coextruded films such as those produced from low and high density polyethylene, high density polyethylene and ethylene vinyl acetate, low density polyethylene and polyvinylidene chloride, high density polyethylene-nylon-ethylene vinyl acetate and propylene-ethylene copolymer, and polyethylene oriented polypropylene.

18. Method of claim 7, wherein the polymeric film is stretched around the package as a multi-layered wrap.

19. Method of claim 18, wherein the multilayered wrap has three wraps.

20. Method of claim 7, wherein the polymeric film is stretched around the package with a pulling force not greater than 20 pounds for a film having 450 percent elongation.

* * * * *